US006595364B1

(12) United States Patent
Palermo, Jr. et al.

(10) Patent No.: US 6,595,364 B1
(45) Date of Patent: Jul. 22, 2003

(54) FLAG UNFURLER ARRANGEMENT

(76) Inventors: Anthony Palermo, Jr., 7399 Tattersall Dr., Chesterland, OH (US) 44026; Robert H. Anderson, 18675 Parkland Dr., Shaker Heights, OH (US) 44122

( * ) Notice: Subject to any disclaimer, the term of this patent is extended or adjusted under 35 U.S.C. 154(b) by 0 days.

(21) Appl. No.: 09/667,480

(22) Filed: Sep. 22, 2000

Related U.S. Application Data

(60) Provisional application No. 60/155,610, filed on Sep. 23, 1999, provisional application No. 60/155,609, filed on Sep. 23, 1999, and provisional application No. 60/155,608, filed on Sep. 23, 1999.

(51) Int. Cl.[7] ..... B65D 85/20

(52) U.S. Cl. ..... 206/443; 206/459.5; 206/478; 206/479; 206/485; 206/778

(58) Field of Search ..... 206/443, 479–481, 206/485, 575, 775–778, 478, 459.5; D11/183

(56) References Cited

U.S. PATENT DOCUMENTS

| | | | | | |
|---|---|---|---|---|---|
| 1,733,825 | A | * | 10/1929 | Rosenthal | 206/479 |
| 1,877,840 | A | * | 9/1932 | Frowenfeld | 206/479 |
| 1,991,306 | A | * | 2/1935 | Woolsey | 206/479 |
| 2,183,428 | A | * | 12/1939 | McNary | 206/479 |
| 2,226,409 | A | * | 12/1940 | Patterson et al. | 206/478 |
| 2,260,787 | A | * | 10/1941 | Nichols et al. | D11/183 |
| 2,298,744 | A | * | 10/1942 | Liermann | D11/183 |
| 2,974,782 | A | * | 3/1961 | Walters | 206/485 |
| 3,978,984 | A | * | 9/1976 | Cowley | 206/443 |
| D268,338 | S | * | 3/1983 | Palmer | D11/183 |
| D302,955 | S | * | 8/1989 | Danniger | D11/183 |
| 5,279,250 | A | | 1/1994 | Palermo, Jr. | |
| 5,483,916 | A | | 1/1996 | Kolvites et al. | |
| 5,943,980 | A | | 8/1999 | Huang | |

* cited by examiner

*Primary Examiner*—Jim Foster
(74) *Attorney, Agent, or Firm*—Timothy B. Gurin

(57) ABSTRACT

Point-of-sale display apparatus for a plurality of flag designs comprises a generally flat back panel having a bottom edge portion and an upper edge portion. A flag retaining means is fastened to the back panel and defines a plurality of loops sized to accommodate a rolled flag in each of the loops. The loops are preferably comprised of elastic material. The upper edge portion may be generally triangular shaped with the apex of the triangle defining a point from which the display apparatus can be hung. The display apparatus also includes a clear, plastic enclosure shaped to accommodate the display apparatus within the enclosure. The display apparatus is used to display for sale a plurality of flag unfurlers and a variety of flag designs, and doubles as a convenient and effective storage container. A quick release final attachable to the top of the flag pole is also provided whereby the removal of one flag and flag unfurler combination from over the top of the flag pole and the mounting of a second flag and flag unfurler combination over the top of the flag pole is facilitated.

11 Claims, 5 Drawing Sheets

FLAG UNFURLER ARRANGEMENT

CROSS REFERENCE TO RELATED APPLICATION

This application claims the benefit of Provisional Application Serial Nos. 60/155,610; 60/155,609; and 60/155,608 all filed Sep. 23, 1999 in the name of Anthony M. Palermo and Robert H. Anderson.

The present invention relates to new and improved arrangements for the display, storage and use of flags, pennants and associated flag unfurlers.

BACKGROUND OF THE INVENTION

In recent years, decorative banners and flags have grown in popularity. It is not uncommon to own several flags depicting various holidays, seasons and sporting events as well as national affiliation. Typically, however, flags and pennants are sold singularly, i.e., a single flag or pennant is packaged in a box perhaps along with a pole and suitable mounting hardware. The point-of-sale display of singular flag arrangements fails to take advantage of opportunities to sell multiple flag and pennant combinations.

Moreover, several disadvantages arise from owning and switching the flags as the particular events come and go throughout the season. Owning many flags leads to storage problems. Typically, the many flags and their associated hardware, e.g., flagpoles, are simple stored loosely or in a cardboard box in a garage or storage closet. Storage in this fashion leads to damage and excessive wear, and allows the flags to become dirty due to dust and other elements.

With conventional mounting arrangements, switching flags requires either having a separate pole on which each flag is mounted or going through the exercise of removing the flag from the pole and reattaching the new one. Typically, flags have thru-hole eyelets along one edge through which halyards or ropes are used to attach the flag to its pole. Other types have a sewn hem along one edge forming an elongated pocket through which the pole is passed to support the flag.

In U.S. Pat. No. 5,279,250 (the "'250 patent"), a flag unfurler is described. The invention of the '250 patent shows an unfurler arrangement whereby the flag is attached to a hollow tube. The flag pole is inserted through the hollow tube which is mounted for rotation about the flag pole. A retaining collar is used to support the unfurler along the longitudinal extent of the pole and to allow the unfurler to rotate about the pole.

Because of frequent flag switching throughout a season, it is desirable to have an arrangement whereby the unfurler/flag combination may be removed over the top of the pole and replaced with a new combination without the need to remove the pole from its mounting bracket or fixture and further without the need to remove and replace the friction washer and retaining collar of the unfurler apparatus.

The invention of the present application overcomes these problems and others.

SUMMARY OF THE INVENTION

It is therefore an object of this invention to provide an improved point-of-sale display arrangement that doubles as a convenient and effective storage container for a variety of flags and pennants, and an improved arrangement and method for quickly and easily switching flags and storing them when not in use.

In accordance with the present invention, point-of-sale display apparatus for a plurality of flag designs is provided.

The display apparatus comprises a generally flat back panel having a bottom edge portion and an upper edge portion. A flag retaining means is fastened to the back panel and defines a plurality of loops sized to accommodate a rolled flag in each of the loops. The loops are preferably comprised of elastic material. The upper edge portion may be generally triangular shaped with the apex of the triangle defining a point from which the display apparatus can be hung. The display apparatus also includes a clear, plastic enclosure shaped to accommodate the display apparatus within the enclosure.

In accordance with another aspect of the present invention, a quick release final attachable to the top of the flag pole is also provided. The quick release finial facilitates removal of one flag and flag unfurler combination from over the top of the flag pole and the mounting of a second flag and flag unfurler combination over the top of the flag pole.

In accordance with yet another aspect of the present invention, a unique flag system arrangement is provided. The flag system includes a plurality of flag unfurlers for mounting a flag thereto, each unfurler comprising a tube rotatably mountable about a flag pole. Each of a plurality of flags are mounted to a respective one of the plurality of flag unfurlers. A flag pole is also provided with a collar positioned along the longitudinal extent of the pole for supporting the tube in position about the pole. A quick release finial is attachable to the top of the flag pole to facilitate the removal of one flag and flag unfurler combination from over the top of the flag pole and the mounting of a second flag and flag unfurler combination over the top of the flag pole.

In accordance with yet another aspect of the present invention, the quick release finial defines an outside diameter less than the inside diameter of the unfurler tube. The finial includes a plurality of spring loaded tabs hingedly attached at one end to the body of the finial near the final top. The tabs, when not compressed, form extensions to maintain a flag unfurler in place about the flag pole, but when compressed, lie close to the body of the finial allowing a flag unfurler to be alternately removed from or placed over the top of the flag pole.

Alternately, the flag pole and finial are threaded to releaseably engage one another.

An advantage of the present invention is that it can be used to display for sale a plurality of flag unfurlers and a variety of flag designs. Moreover, it can double as a convenient and effective storage container.

An advantage of this arrangement is that the flag and pole need not be removed from the mounting base in order to change the flag.

Still further advantages of the present invention will become apparent to those of ordinary skill in the art upon reading and understanding the following detailed description.

BRIEF DESCRIPTION OF THE DRAWINGS

FIG. 4(*b*) is a side, cutaway view of the quick release feature of the present invention shown in FIG. 4(*a*) but with tabs compressed.

DETAILED DESCRIPTION OF THE PREFERRED EMBODIMENT

One aspect of the present invention is a new and novel arrangement to package for sale and to store a plurality of flag unfurlers and their associated flags, pennants or banners. In this specification, the terms flag, pennant or banner are used interchangeably to denote any piece of cloth, bunting or other suitable material bearing devices, symbols or colors to designate a nation, state, organization, affiliation or the like.

Figure 1:
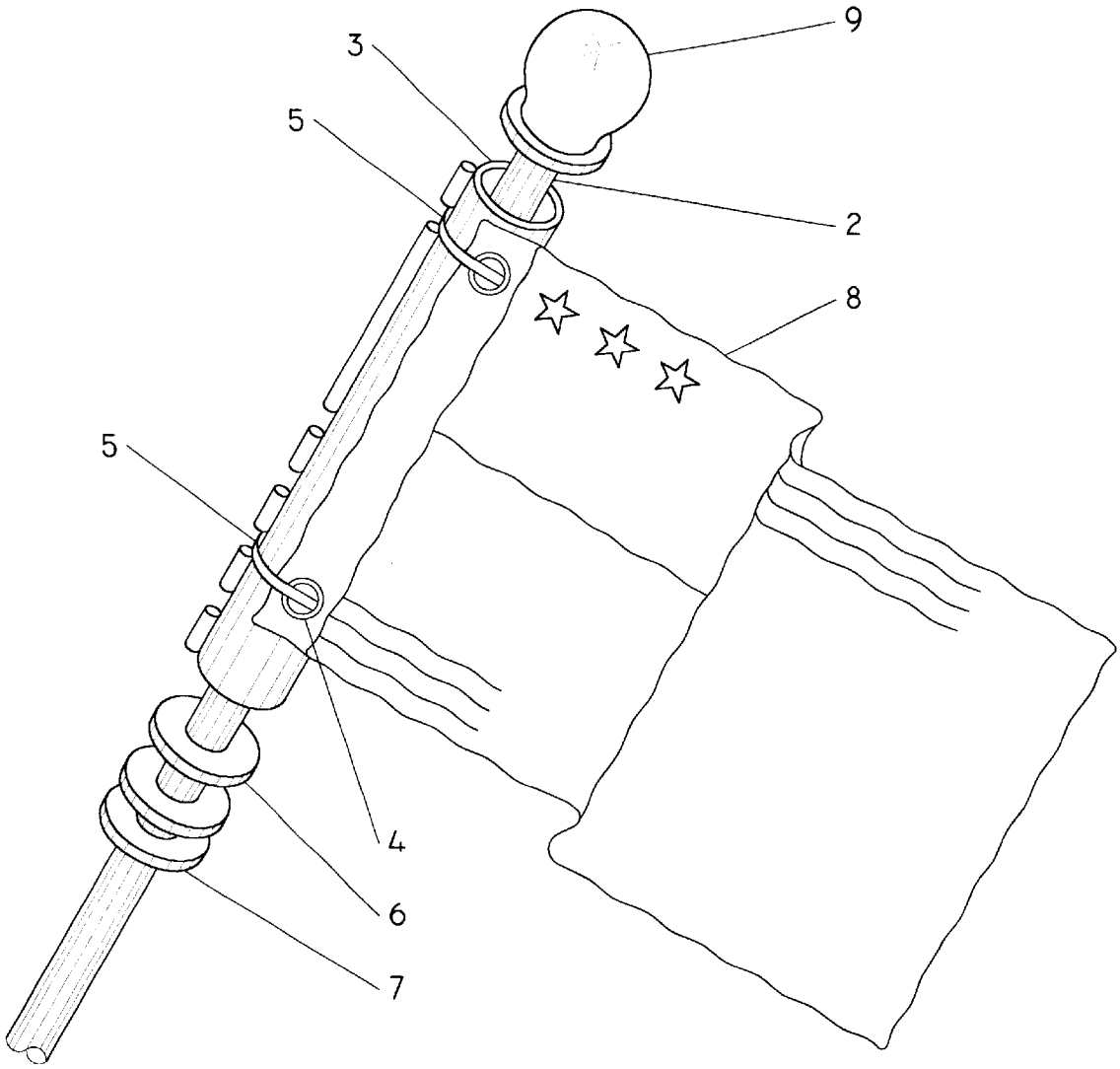
FIG. 1 is an exploded perspective view of a flag unfurler arrangement.

In U.S. Pat. No. 5,279,250 (the "'250 patent"), a flag unfurler is described. The '250 patent is hereby incorporated by reference. Referring to FIG. 1, the unfurler arrangement of the '250 patent is generally described. An extruded thin walled, preferably plastic tube 3 is provided. The tube has sufficient inside diameter to fit around a conventional flag pole 2 with sufficient clearance that it rotates freely about the longitudinal extent of the flag pole. A friction reducing washer 6 fits around the pole and below the tube 3. A collar 7 is engaged around the pole to secure the tube and washer in appropriate position along the length of the pole. Whether the pole is mounted in a vertical upright position or some angle from vertical, gravity acts to engage the tube against the washer 6 on top of the collar 7. A flag or pennant 8 is mounted to the tube by virtue of cable ties 5 wrapped around the tube and through eyelets 4 on a peripheral edge of flag. A finial 9 is typically secured to the top of the pole 2.

Figure 2:
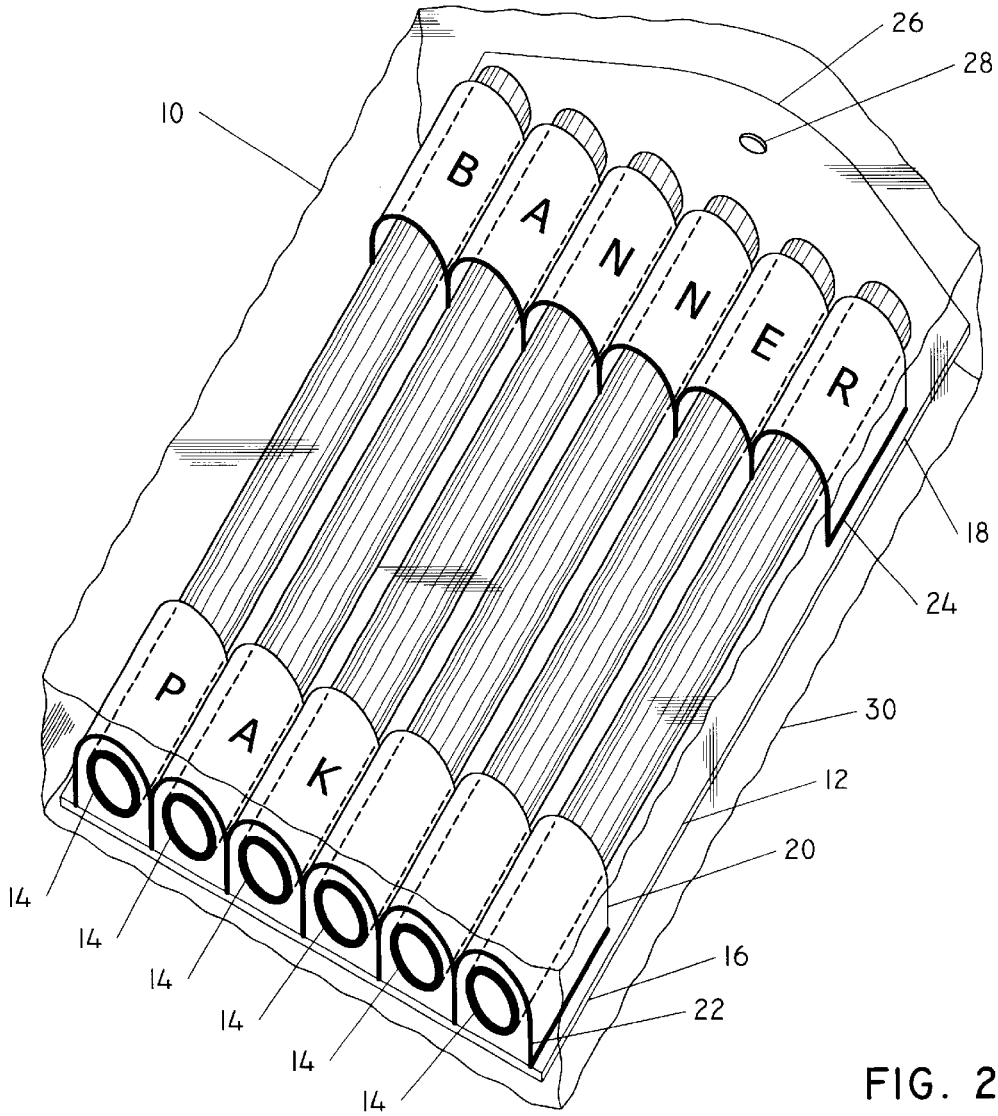
FIG. 2 is a perspective view of one aspect of the present invention.

Referring now to FIG. 2, a point-of-sale display apparatus for a plurality of flag or pennant designs of the present invention is shown. The point-of-sale display apparatus 10 includes a back portion 12 made from canvas or other suitably flexible material. Alternatively, cardboard or other semi-rigid material could be used. The backboard 12 is sized to accommodate the desired number of flag unfurlers to be packaged and their length. In the preferred embodiment, six unfurlers 14 are shown schematically although any desired number could be chosen.

The back portion 12 defines a bottom edge portion 16 and an upper edge portion 18. Along the bottom edge portion of the backboard is a retaining strip or band 20. The retaining strip is comprised of suitably sturdy fabric, plastic or elastic material. The retaining strip is fastened to the backboard to form loops 22 to accommodate and hold in place each of the flag unfurlers to be packaged. The strip can be fastened to the back portion by sewing, adhesive, stapling or other suitable fastening means. It is to be appreciated that the loops 22 have an inside diameter slightly larger than the outside diameter of the unfurler tube to accommodate the tube within the loop. The retaining strip may also be formed to close off the bottom of the loops thus forming pockets in which to hold each of the flag assemblies in place. Alternately, if an elastic material is used, the loops 22, in an unstretched condition, may have an inside diameter slightly less than the outside diameter of the flag unfurlers. In this fashion, when the unfurler is placed into the loop, slight elastic pressure will be applied to hold the unfurler in place. A similar retaining strip or band 24 is also provided along the upper portion 18 of the backboard to similarly hold the upper portions of the unfurlers in place. Appropriate printing may be provided along the upper and lower strips as may be desired for sales or advertising purposes.

The backboard 12 may be shaped at the upper edge to form a hanger arrangement so that the package may be displayed for sale or conveniently stored. The upper end of the backboard may be triangularly shaped such that the apex 26 of the triangle forms a convenient hanging point 28. A hole reinforced by an eyelet at the hanging point allows the package to be hung on a hook or rod. Alternatively, a hanger, similar to a clothes hanger, may be fastened to the upper edge of the backboard 12 and provides a suitable hanging arrangement.

The package assembly is preferable enclosed in a reusable plastic bag 30, shown schematically, sized and shaped to accommodate the assembly along with the unfurlers and flags. The plastic bag protects the unfurlers and flags from the elements while on display and during storage.

The packaging arrangement of the present invention can be used for the display for sale of a suitable number of flag unfurlers and subsequently used by the consumer to store the flag/unfurler combination when not in use. It is to be appreciated that when a flag is to be included with an unfurler, the flag can be simply rolled around the unfurler to fit within the retaining loops. Having multiple flag unfurlers with individual flag designs attached thereto simplifies the change process. Instead of having to detach and reattach the different flags to the pole or lanyard, one simply removes the unfurler/flag combination from the pole and replaces it with the new combination. Alternatively, for those flag arrangements that use a small, dowellike, pole that is easily removable from its mounting base, the pole could also be displayed or stored along with the unfurler/flag combination.

Figure 3:
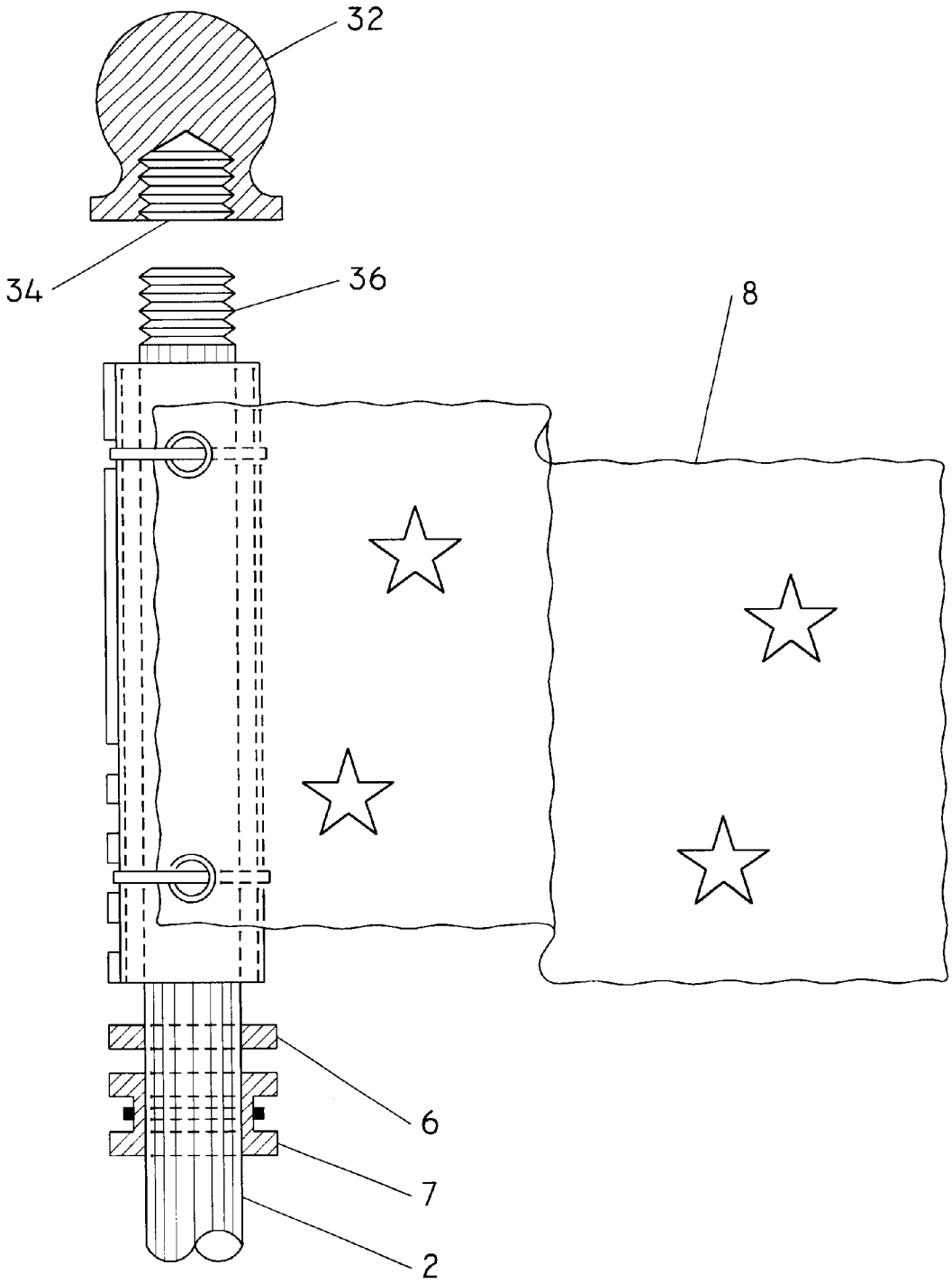
FIG. 3 is a perspective view of the quick release feature of the present invention.

This process is further simplified by other aspects of the present invention which include novel finial arrangements which allow quick and easy removal of a unfurler/flag combination over the top of a flag pole in order that the pole need not be removed from its mounting base. Referring to FIG. 3, a quick release/attach final 32 is shown. The finial 32 is threaded in the hole 34 that accepts the upper end of the flag pole 36. Likewise, the upper end of the pole 36 is threaded to fit the finial and threadably engage the finial. In use, one unscrews the finial from the top of the pole 2 and places the tube of an unfurler over the top of the pole. The retaining collar 7 holds the unfurler tube along the longitudinal extent of the pole. When the unfurler is in place, the finial is screwed back in place on top of the pole to capture the flag/unfurler combination on the pole.

Figure 4A:
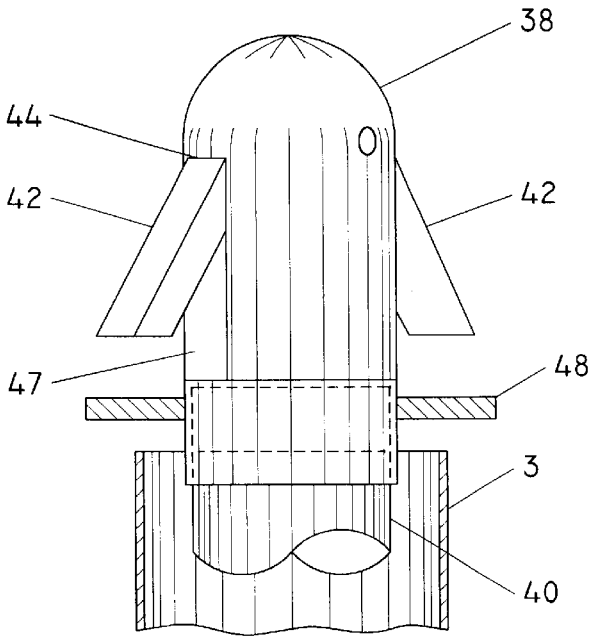
FIG. 4(*a*) is a perspective view of an alternate embodiment of the quick release feature of the present invention with tabs extended.
Figure 4B:
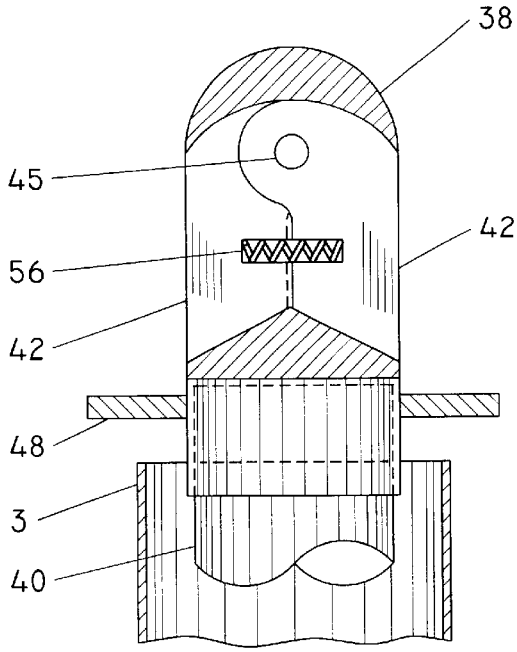

Another embodiment of a quick release finial is shown in FIGS. 4(*a*) and 4(*b*). The finial 38 is fixedly attached to the top of a flag pole 40 and has an outside diameter less than the inside diameter of the unfurler tube. Two spring loaded tabs 42 are hingeadly attached at one end 44 to the body of the finial 38 near the final top and rotate about pivot point 45. When extended as shown in FIG. 4(*a*), the tabs 42 extend outwardly from the finial body 46 toward the lower end of the finial forming an arrowhead-like arrangement. When compressed as shown in FIG. 4(*b*), the tabs 42 extend within the body of the finial 46 in recesses 47. Spring 56 is situated between the tabs to apply an extension force to the tabs. In use, the tabs 42 are compressed by hand and the unfurler tube placed over the top of the pole. The tube is slid down the pole until in position at which point the opposite end of the tube clears the finial allowing the tabs to extend by the force applied by spring 56. The extended tabs prevent the tube from moving over the top of the pole thus capturing the flag/unfurler combination on the pole. Likewise, when removing an unfurler/flag combination, one simply compresses the two tabs 42 against spring 56 and slides the tube over the top of the pole. A washer 48 may optionally be used between the tube and final in the event the inside diameter of the tube is larger than the diameter of the tabs or to provide friction reduction between the two pieces.

Figure 5:
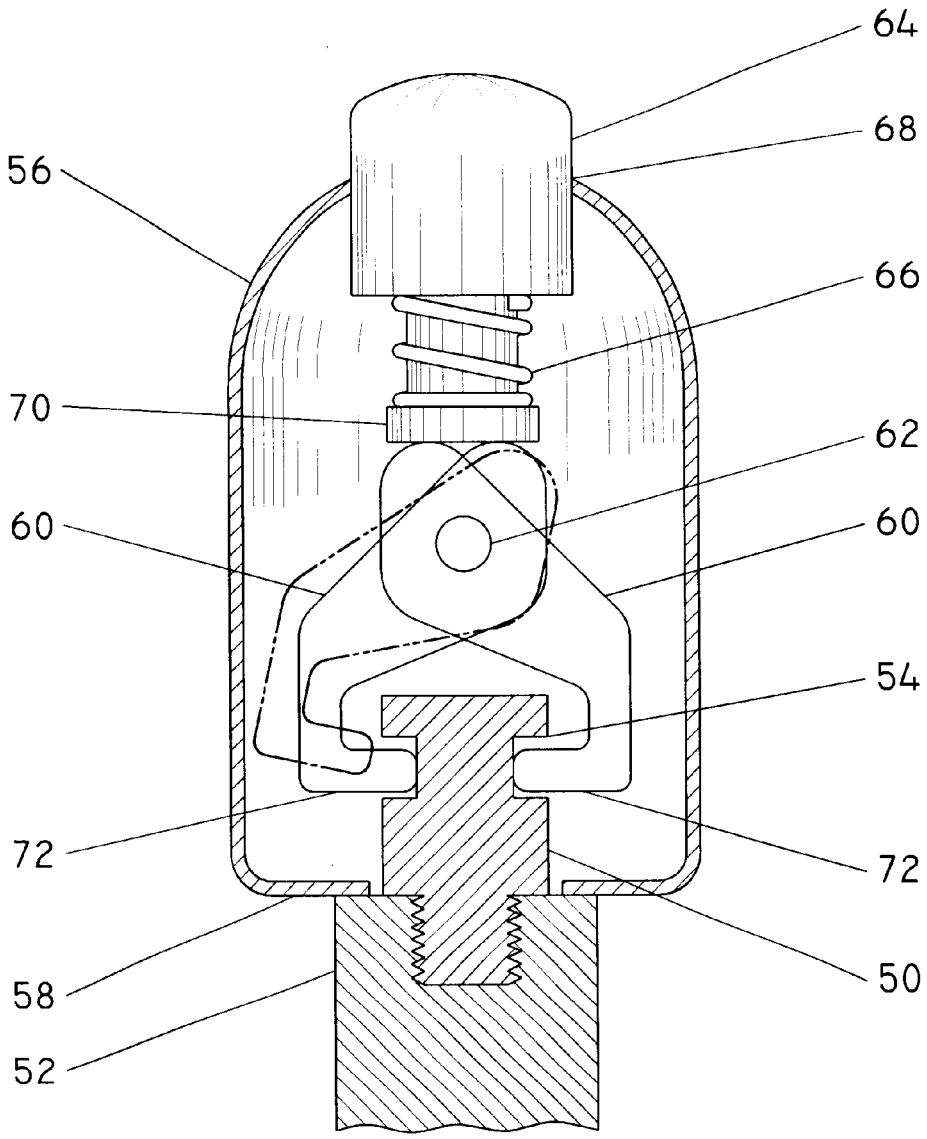
FIG. 5 is a side, cutaway view of an alternate embodiment of the quick release feature of the present invention.

Yet another embodiment of a quick release finial is shown in FIG. 5. A retaining bonnet 50 is threadably engaged to the top of the flag pole 52. The bonnet is a circular shaped piece with a groove 54 cut about the circumference of the bonnet about midway along its longitudinal extent. The final 56 is a cup arrangement defining a hollow interior. A lip 58 defines a support surface on which the finial rests on the top of the pole and defines an access hole having an inside diameter greater than the outside diameter of bonnet 50. A pair of C-shaped grippers 60 are hingedly attached at one end about pivot axis 62 which extends through the body of final 56. A spring loaded push button 64 includes a plunger 66. The plunger 66 extends through hole 68 in the top of the final. The distal end 70 of the plunger engages the grippers at the pivot axis 62 from above. When compressed downwardly into the finial body, the plunger 66 forces the grippers to rotate slightly about the pivot point to extend the gripper tabs 72 to clear the bonnet (shown in phantom). When the finial is placed over the bonnet on top of the pole and pressed downwardly, the top of the bonnet engages the grippers at the pivot point 66 from below. Downward force on the finial causes the grippers to rotate engaging the gripper tabs in groove 54. In use, push button 64 is pressed downwardly to disengage the final from the top of the pole. The unfurler tube is slid down the pole until in position. The finial is placed back over the top of the pole and pressed downwardly on to the bonnet causing the finial tabs to engage the groove and secure the finial to the pole. Likewise, when removing an unfurler/flag combination, one simply reverses the operation and slides the tube over the top of the pole.

The invention has been described with reference to the preferred embodiments. Obviously, modifications and alterations may occur to others upon reading and understanding the preceding detailed description. It is intended that the invention be construed as including all such modifications and alterations insofar as they come within the scope of the appended claims or their equivalents.

Having thus described the preferred embodiment, we claim:

1. Point-of-sale display apparatus for a plurality of flag designs comprising:

a generally flat back panel having a bottom edge portion and an upper edge portion;

a flag retaining means fastened to the back panel, said flag retaining means defining a plurality of loops sized to accommodate a flag unfurler in each of the loops, wherein the flag retaining means comprises elastic material; and a plurality of flag unfurlers, each unfurler being removably accommodated in a respective one of said loops.

2. The apparatus of claim 1 wherein the upper edge portion is of a generally triangular shape and the apex of the triangle defines a point from which the display apparatus can be hung.

3. The apparatus of claim 1 wherein the flag retaining means comprises a first retaining strip along the bottom edge portion of the display apparatus and a second retaining strip near the upper edge portion.

4. The apparatus of claim 1 further comprising an enclosure shaped to accommodate the display apparatus within the enclosure.

5. The apparatus of claim 4 wherein the enclosure comprises clear, plastic material.

6. The apparatus of claim 1 further comprising a plurality of flags, each of said flags rolled about a respective one of said flag unfurlers.

7. A point of sale display apparatus for a plurality of flags, comprising:

a backing panel having an upper set of loops and a lower set of loops;

a plurality of rolled flags, each flag being retained in a respective one of said upper loops and respective one of said lower loops;

an enclosure enclosing said back panel and said flags, and including a transparent region adapted to permit viewing said flags through said enclosure.

8. The apparatus of claim 7 wherein said loops comprise elastic material.

9. A point of sale display apparatus for a plurality of flags, comprising:

a backing panel having an upper set of loops and a lower set of loops;

a plurality of flag unfurlers, each unfurler being removably retained in a respective one of said upper loops and respective one of said lower loops;

an enclosure enclosing said back panel and said loops, and including a transparent region adapted to permit viewing said unfurlers through said enclosure when retained in said loops.

10. The apparatus of claim 9 further comprising a plurality of flags, each of said flags rolled about a respective one of said flag unfurlers.

11. The apparatus of claim 9 wherein said loops comprise elastic material.

* * * * *